United States Patent [19]

Kobsa et al.

[11] Patent Number: 4,559,196

[45] Date of Patent: Dec. 17, 1985

[54] PROCESS FOR IMPROVING THE DYEABILITY OF NYLON CARPET FIBER

[75] Inventors: Henry Kobsa, Greenville; William T. Windley, Seaford, both of Del.

[73] Assignee: E. I. Du Pont de Nemours and Company, Wilmington, Del.

[21] Appl. No.: 599,409

[22] Filed: Apr. 12, 1984

[51] Int. Cl.[4] ..... D01D 5/22

[52] U.S. Cl. ..... 264/168; 264/171; 264/176 F; 264/210.5; 264/345

[58] Field of Search ..... 264/176 F, 171, 342 R, 264/342 RE, 345, 168, 210.5; 528/324, 335

[56] References Cited

U.S. PATENT DOCUMENTS

| | | | |
|---|---|---|---|
| 3,003,222 | 10/1961 | Pitzl | 264/342 R |
| 3,322,731 | 5/1967 | Cook et al. | 528/324 |
| 3,511,815 | 5/1970 | Sayin | 528/335 |
| 3,536,802 | 10/1970 | Uraya et al. | 264/171 |
| 3,557,544 | 1/1971 | Simons . | |
| 3,707,522 | 12/1972 | Simons | 528/324 |

FOREIGN PATENT DOCUMENTS

| | | |
|---|---|---|
| 1072098 | 6/1967 | United Kingdom . |

*Primary Examiner*—Donald Czaja
*Assistant Examiner*—Hubert C. Lorin

[57] ABSTRACT

The dyeability of carpet yarns prepared from random copolymers of nylon 66 and 6–12 wt. % nylon 6 is improved by subjecting the yarn to saturated steam at temperatures close to the melting point of the copolymer. The copolymers used in the invention have an amine end content of 30–80 gram equivalents per 1000 kilograms of polymer and a relative viscosity of 55–85 in filament form.

3 Claims, 3 Drawing Figures

PROCESS FOR IMPROVING THE DYEABILITY OF NYLON CARPET FIBER

BACKGROUND OF THE INVENTION

1. Field of the Invention

This invention pertains to a process for improving the dyeability of carpet yarns made from copolymers of nylon 66 and small amounts of nylon 6.

2. Description of the Prior Art

Polyamide yarns, particularly nylon 66, are highly preferred for use in carpets because of their durability and crimp/bulk retention under hard wear conditions. Although nylon 66 is easier to dye than many other fibers, large amounts of heat energy are used in the dyeing operation. For example, in the batch dyeing of nylon 66 carpet by the method called Beck dyeing, the carpet has had to be maintained in an agitated dye liquor at temperatures near boiling for 30–45 minutes to insure adequate, uniform penetration of dye into the fiber structure. While Beck dyeing without the application of heat has been suggested, it has not been possible to achieve uniform dye uptake throughout the carpet piece in a time period that would be practical for a commercial carpet dyeing operation. Continuous dyeing equipment is a more recent innovation in carpet dyeing. In this type of an operation, the carpet moves continuously as dyes are applied by such means as immersion in a dye bath, spraying or printing. The dyes are then fixed by passing the carpet through a steam chamber at a rate that will provide sufficient retention time to allow the dye molecules to penetrate within the polymer and attach to the polymer chains. Thus, in both Beck dyeing and continuous dyeing, large amounts of energy must be expended to achieve uniform durable colors in carpet yarns.

SUMMARY OF THE INVENTION

It is an object of the present invention to reduce the amount of heat energy required to dye carpets containing nylon 66. This is accomplished by preparing the carpet yarn from random copolymers of nylon 66 (polyhexamethylene adipamide) and 6–12% by weight of nylon 6 (polycaprolactam) based on total polymer weight, in addition to having a random structure where the nylon 66 segments and the nylon 6 segments are distributed randomly throughout the polymer chain, the copolymers used in the present invention have an amine end content of 30–80 gram equivalents per 1000 kilograms of polymer and a relative viscosity of 55–85 in filament form. It has been found that when yarns spun (extruded) from such a copolymers are heated with saturated steam to temperatures up to about the melting point of the polymer, the properties of the yarn are such that it can be dyed with much less of an expenditure of heat energy during the dyeing operation. For example, it will be seen from the examples which appear later in this specification that carpets manufactured from yarns prepared according to the present invention can be dyed to attractive colors at room temperature.

The setting of carpet yarns with saturated steam is a conventional step in the manufacture of carpets. However, carrying out saturated steam heat setting at the temperatures specified in this invention coupled with the use of nylon 66/nylon 6 copolymers as described herein as the source of the carpet yarn provides unexpected advantages in the dyeing of carpets made from such yarns. In the practice of this invention, the yarn is brought to a temperature in the vicinity of its melting point, but not sufficient to adversely affect the quality of the yarn and render it unsatisfactory for carpet manufacture. Such temperatures will vary depending on the composition of the random copolymer particularly its nylon 6 content. It will be seen from Table I below which gives melting points in saturated steam and what is generally the recommended minimum steam heating temperature that less heat is applied as the nylon 6 content increases. The yarn when subjected to the saturated steam may be in either continuous or staple form and can be either bulked or crimped as is conventional in the manufacture of carpet yarns. Heating can be conducted batch-wise in an autoclave or on a continuous basis in continuous heat setting machines that are commercially available.

TABLE I

| Nylon Copolymer | | Melting Point In Saturated Steam | Minimum Heating Temperature In | Pressure when Saturated Steam is at Minimum Heating |
|---|---|---|---|---|
| % Nylon 66 | % Nylon 6 | Temp. (°C.) | Saturated Steam Temp. (°C.) | Temperature Pressure (atm.) |
| 94 | 6 | 167 | 139 | 3.58 |
| 92 | 8 | 164 | 132 | 2.92 |
| 90 | 10 | 160 | 122 | 2.16 |
| 88 | 12 | 157 | 110 | 1.46 |

While Table I shows minimum setting temperatures to achieve adequately rapid dyeing, use of saturated steam setting temperatures within about 10° C. of the polymer melting point should be carefully evaluated to determine whether there are any undesirable effects such as an unacceptable deterioration in bulk or other physical properties of the yarn or fusing of filaments to each other. The treatment with the saturated steam does not require holding the yarn at temperature for longer than necessary to insure that steam has reached all portions of the filaments and has brought them up to the desired temperature. The time to accomplish this depends on the density of the yarn bundle as it travels through the steam environment and on the efficiency of heat transfer to the yarn. The minimum heating temperature for compositions not specifically given in Table I can be obtained by interpolation using the data presented. Copolymers shown in this Table I with 6% or more of nylon 6 have minimum setting conditions within capabilities of commercial equipment. Copolymers having more than 12% nylon 6 have progressively lower tenacity and higher shrinkage.

A preferred embodiment of this invention comprises the use of random copolymer containing 8–10% by weight of nylon 6 having a relative viscosity of 65–75 and 40–70 amine ends per 1000 kilograms of copolymer. Yarns from copolymers of 10% by weight of nylon 6 are especially preferred. They have attractive luster and clarity and there is an absence of spherulites which are normally present in nylon 66 and cause light to diffuse.

DETAILED DESCRIPTION

Figure 1:
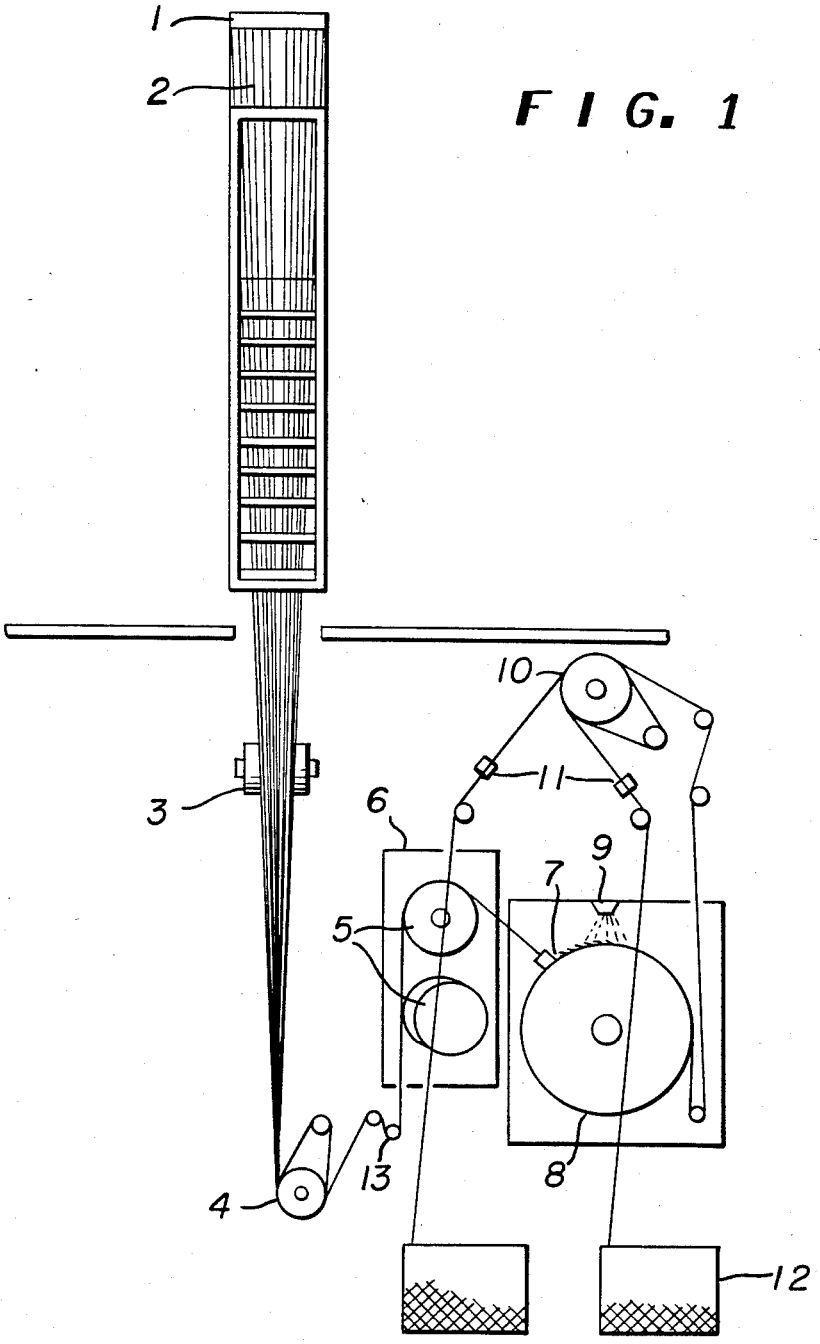
FIG. 1 is a schematic diagram of a spin/draw/bulk procedure useful in preparing carpet yarns that are steam heat set according to the process of the present invention.

The nylon copolymers used in this invention are prepared by conventional salt blending procedures for nylon production. In this method of preparation, the nylon 66 segments and nylon 6 segments in the resulting product are randomly distributed in the polymer chain. This random distribution is considered to be one of the factors that causes these random copolymers to have a faster dye rate than block copolymers made by melt blending nylon 66 and nylon 6. In addition to possessing a random structure, the copolymers of the present invention should have a relative viscosity in filament form of about 55–85 and preferably about 65–75. These high relative viscosities are considered to be indicative of a balance between amine and carboxyl end groups in the copolymers that enhance their dyeing properties and make for faster dyeing rates. The copolymers should have an amine end content of about 30–80 gram equialents per 1000 kilograms of copolymer. The preferred range for the amine end content of the copolymers is 40–70 gram equivalents. Methods for determining relative viscosity and amine end group content are described in the prior art; for example, procedures for these determinations are described in U.S. Pat. No. 3,511,815. It will also be apparent from the aforementioned patent that various techniques are known in the art for adjusting reactants and reaction conditions in order to have the relative viscosity and the amine end group content fall within desired ranges.

The copolymers of this invention may contain, in addition to nylon 66 and nylon 6, conventional additives used in the production of nylon filament, such as plasticizers, delustrants, such as polyethylene oxide or $TiO_2$, heat and light stabilizers, antistatic agents, polymerization aids, catalysts, pigments and the like. The spinning methods used are those normally used in the spinning of carpet filaments. To avoid gelling of the copolymer, the lowest practical spinning temperature should be used. The spinning temperature should usually be below 290° C. and preferably below 285° C.

In most cases, yarns prepared according to the present invention can be dyed at room temperature. In cases where it may be advantageous to supply some degree of heat, it will be significantly less than is presently used in commercial carpet dyeing operations. Dyeing may be advantageously accomplished at a pH of about 4 or less because dye is absorbed more rapidly at these conditions, but a pH of about 6 or even higher may be employed if the particular heat set copolymer filaments have adequately rapid dye rates.

The dyed filaments of the invention have satisfactory dye uptake and leveling, resistance to bleeding and ozone attack. The tenacity and shrinkage of the filaments are also within commercially acceptable limits.

The benefits of the present process are also seen in the color clarity of patterns printed on carpets due to rapid and complete absorption of dye at the edges of patterns, thus eliminating any seeping of dye into adjacent areas where it is not wanted. The filaments also more readily and completely absorb fluorine compounds which are applied to some products to repel soiling, and they retain such compounds more tenaciously. Most surprisingly, the copolymers described herein provide resistance to ozone attack on the dye that is equal to or better than nylon 66 alone, and much better than nylon 6 alone.

EXAMPLES

The following examples illustrate the process of this invention. Unless otherwise specified, all parts are by weight.

EXAMPLE 1

A 52 wt% water solution of nylon 66 salt prepared from 1201 pounds of hexamethylene diamine and 1512 pounds of adipic acid are added to an evaporator along with 13.6 pounds of 100% hexamethylene diamine, 506 ml of 9.09% manganese hypophosphite solution, 200 ml of antifoaming agent, and 283 pounds of caprolactam. Water is removed in the evaporator until the solids content is 80–85% by weight. The mixture is then placed in an autoclave along with 39.9 pounds of a 20% water slurry of $TiO_2$, and over a period of 134 minutes, the temperature is raised until it is slightly above the melt temperature of the polymer that has formed. The polymer is cast by inert gas extrusion at 265° C. into cooling water until its temperature is reduced to a maximum of 60° C. The extruded ribbon is then cut and cooled in a blender exhaust station for 1.5 hours before storing. The resultant 66/6 flake (90 wt % 66/10 wt % 6) has a relative viscosity of 38, 86 amine ends, 11 ppm manganese and 0.3% $TiO_2$. The flake is then placed into a hopper supplying a flake conditioner at a rate sufficient to allow six to ten hours residence time in the conditioner during which time inert gas or nitrogen at 106°–180° C. is recirculated through the flake to solid-state polymerize it and increase its relative viscosity. The conditioned flake is supplied to a screw melter with inlet temperature zone set at 205° C. and internal zones set at 260°, 270°, and 280° C. progressively. Molten polymer is discharged from the screw melter into a transfer line at 284° C. and piped to a spin pump having capacity of greater than 600 grams per minute. Referring now to FIG. 1 of the drawing, molten polymer from the spin pump is extruded at a rate of 3.9 grams/minute/capillary through spinneret 1 at 283° C. forming filaments 2 quenched with 15.6° C. air at 80 percent relative humidity at a rate of 8.49 $m^3$/minute followed by application of an aqueous finish by roll 3 rotating at 38 revolutions/minute. Feed roll 4 controls the spun yarn speed at 750 meters/minute. Skewed rolls 5 have a surface temperature of 190° C. and a surface speed of 2233 meters/minute. Yarn filaments 2 are drawn over pins 13 by skewed rolls 5 to 2.9×. Insulated enclosure 6 reduces loss of heat energy from rolls 5. With 7½ wraps on rolls 5, yarn 2 is preheated and advanced to jet 7 supplied with air at 235° C. and 7.4 atm. gauge pressure. Yarn 2 is removed from jet 7 by a rotating 24 mesh screen on drum 8 with a surface speed of 71.7 meters/minute and is held onto the screen by a vacuum of 25.4 cm $H_2O$ inside the drum. Mist quench nozzle 9 provides added cooling to yarn 2 by $H_2O$ spray at a rate of about 90 ml/minute. Take up roll 10 with a surface speed of about 1784 meters/minute removes the yarn from screen drum 8 and advances it over secondary finish applicator 11 to windup 12 where it is wound on tubes at about 1839 meters/minute. The resultant trilobal yarn had properties as listed in Tables II and III.

Yarn of this Example was then heat set in saturated steam temperatures ranging from 121° C. to 143° C. It will be seen from the last main heading at the bottom of Table III that the dyeing property referred to as Cold Dye Rate $\times 10^{-5}$ Sec$^{-1}$ increased from 476 in the yarn, as produced, to 7670 when treated according to the present invention at 143° C. Cold dye rate determinations are an indication of the ability of a yarn to dye at ambient temperatures. The method used to determine the cold dye rates set forth in Tables III, V, and VII is a refinement of the method discussed by H. Kobsa in the Book of Papers of the 1982 National Conference of the American Association of Textile Chemists and Colorists. In comparison to this, yarns described as Controls 1 and 2 of Tables I and II dyed under the same conditions absorbed little dye and were judged to be unacceptable by commercial standards.

A carpet sample was made from the yarn of Example 1 which had been heat set at 143° C. at conditions shown in Table IV. When dyed at pH 4 at room temperature, the carpet dyed level and required no external heat energy to fix the dye.

EXAMPLES 2 AND 3

The yarns of these examples were prepared according to the procedure described in Example 1 with the changes noted below. The yarn of Example 2 had four void hollow filaments and the quench air flow was increased to 11.32 meters$^3$/minute. The yarn of Example 3 was dead bright (no $TiO_2$ was used), and the flake was conditioned less to obtain a relative viscosity of 64. The resulting yarns had properties as listed in Tables II and III, and the carpet specifications are set forth in Table IV.

TABLE II

| | Example 1 | Example 2 | Example 3 | Control 1 | Control 2 |
|---|---|---|---|---|---|
| Dye Type | RTD Acid | RTD Acid | RTD Acid | Deep Acid | Deep Acid |
| Polymer Type | 66/6 | 66/6 | 66/6 | 66 | 66 |
| Blend Ratio | 90/10% | 90/10% | 90/10% | 100% | 100% |
| RV | 75 | 75 | 64 | 72 | 65 |
| $NH_2$ | 68 | 68 | 68 | 57 | 70 |
| COOH | 52 | 52 | 67 | 41** | 33** |
| Luster | S.D. | S.D. | D.B. | S.D. | D.B. |
| Percent $TiO_2$ | 0.3 | 0.3 | 0.0 | 0.3 | 0.0 |
| Percent Finish on Yarn | 0.8 | 0.8 | 0.8 | 0.8 | 0.8 |
| Cross Section | Trilobal | H.F. | Trilobal | H.F. | Trilobal |
| Modification Ratio | 2.9 | — | 2.6 | | 2.3 |
| Void Level (%) | — | 25 | — | <15 | — |
| Bulk* | 23.0 | 24.0 | 8.4 | 32.8 | 14.0 |
| Before Boil Off Properties | | | | | |
| Denier | 1286 | 1252 | 1167 | 1261 | 1363 |
| Denier Per Filament | 18.9 | 18.4 | 17.2 | 18.5 | 20 |
| Tenacity (g/d) | 2.2 | 3.0 | 2.8 | 3.4 | 2.7 |
| Elongation (%) | 44.9 | 44.4 | 48.0 | 53.0 | 41.0 |
| Modulus | 4.6 | 6.3 | 7.0 | 10.9 | 10.1 |
| After Boil Off Properties | | | | | |
| Denier | 1265 | 1250 | 1200 | 1279 | 1381 |
| Denier Per Filament | 18.6 | 18.4 | 17.6 | 20.0 | 20.3 |
| Tenacity (g/d) | 2.2 | 2.8 | 2.7 | 3.2 | 2.8 |
| Elongation (%) | 46 | 51 | 65 | 53.0 | 48.0 |
| Modulus | 3.98 | 4.83 | 3.13 | 8.80 | 8.09 |
| Percent Bulk Crimp Elon. | 46.9 | 53.4 | 37.1 | 62.8 | 23.2 |
| Crimp/cm | 2.04 | 2.48 | 1.53 | 5.2 | 3.3 |
| Percent Loop Shrinkage | 4.57 | 5.76 | 5.97 | 2.05 | 3.38 |

*Method Described in U.S. Pat. No. 4,295,252
**Data obtained from Tables

TABLE III

| | Example 1 | Example 2 | Example 3 | Control 1 | Control 2 |
|---|---|---|---|---|---|
| Structural Properties | | | | | |
| Small Angle X-Ray | | | | | |
| Large Point Diffraction Intensity | 6.0 | 1.0 | 1.0 | 1.0 | 1.0 |
| Large Period Diffraction Shape | 1.62 | 2.30 | 2.10 | 2.00 | 2.00 |
| Radius of Gyration | 184 | 108 | 142 | 98 | 135 |
| Dynamic Mechanical Properties | | | | | |
| Before Heat Setting | | | | | |
| Zero Modulus Peak Temp. °C. | 84.5 | 91.0 | 91.5 | | 105.9 |
| 100° C. Elongation % | 31 | 25 | 16 | | 13 |
| 46° C. Modulus (g/d) | 35.3 | 37.7 | 43.6 | | 44.8 |
| After Heat Setting | | | | | |
| Loss Modulus Peak Temp. °C. | 50.0 | | 51.0 | | 82.0 |
| 100° C. Elongation | 36 | | 30 | | 14 |
| 46° C. Modulus (g/d) | 27.8 | | 3.06 | | 42.5 |
| Sonic Modulus | 26 | 37.2 | 34.5 | 37.6 | 41.7 |
| Cold Dye Rate $\times 10^{-5}$ Sec$^{-1(a)}$ | | | | | |
| Fiber As Produced | 476 | 113 | 199 | 8 | 13 |
| After Autoclave Steam Heat Set At: | | | | | |
| 121° C. pH 4 | 904 | 287 | 550 | | 11.1 |
| 127° C. pH 4 | 1990 | 648 | 584 | | 19.5 |

TABLE III-continued

| | Example 1 | Example 2 | Example 3 | Control 1 | Control 2 |
|---|---|---|---|---|---|
| 132° C. pH 4 | 3750 | 800 | 1060 | | 32.6 |
| 138° C. pH 4 | 8070 | 2630 | 5050 | 31 | 61.8 |
| 143° C. pH 4 | 7670 | 3500 | 6820 | | 140.0 |

[a]0.632% color index Acid Blue 40, 49 liquor ratio, 25° C.

TABLE IV

| | Example 1 | Example 2 | Example 3 |
|---|---|---|---|
| Style | Cut Pile | Cut Pile | Cut Pile |
| Tufter Gauge | 1/8" | 1/8" | 1/8" |
| Pile Height | 5/8" | 5/8" | 5/8" |
| Weight, Oz./Yd.$^2$ | 30 | 30 | 35 |
| Primary Backing | Typar | Typar | Typar |
| Secondary Backing | Jute | Jute | Jute |
| Dye Type | C.I. Acid Blue 40 | C.I. Acid Blue 40 | C.I. Acid Blue 40 |
| Color | Blue | Blue | Blue |
| Dye Process | Pot | Pot | Pot |
| Dye Concentration | 2% | 2% | 2% |
| Liquor Ratio | 40:1 | 40:1 | 40:1 |
| Dye Temperature | 25° C. | 25° C. | 25° C. |
| pH Adjustment | 8–4 | 8–4 | 8–4 |
| Yarn Twist (Singles) | 3.5Z | 3.5Z | 3.5Z |
| Yarn Twist (Ply) (TPI) | 3.5S | 3.5S | 3.5S |
| Autoclave Heat Set T° C. | 143 | 143 | 132 |

EXAMPLE 4

The yarns of Example 4 were prepared by the procedures of Example 1 except that the percentage of nylon 6 was varied over the range of 7 to 20%. Also, Examples 4A, 4B, 4C and 4E contained 0.0% $TiO_2$, while Examples 4D and 4F contained 0.3% $TiO_2$.

Tests show that cold dye rate increased as the percentage of nylon 6 was increased and that tensile properties decreased. Test data is summarized in Table V. A banded test carpet demonstrated that all of the yarns of Example 4 could be considered room temperature dyeable after steam heat setting at 138° C. Details of a test carpet with attractive aesthetics constructed from Example 4 products are listed in Table VI.

TABLE V

| | Example 4A | Example 4B | Example 4C | Example 4D | Example 4E | Example 4F |
|---|---|---|---|---|---|---|
| Polymer Type | 66/6 | 66/6 | 66/6 | 66/6 | 66/6 | 66/6 |
| Blend Ratio | 93/7% | 92/8% | 91/9% | 90/10% | 88/12% | 80/20% |
| RV | 75 | 72 | 75 | 71 | 71 | 55 |
| $NH_2$ | 55 | 56 | 70 | 72 | 67 | 73 |
| COOH | 43 | 44 | 30 | 38 | 35 | 44 |
| Luster | D.B. | D.B. | D.B | S.D. | D.B. | D.B. |
| Percent $TiO_2$ | 0.0 | 0.0 | 0.0 | 0.3 | 0.0 | 0.3 |
| Percent Finish on Yarn | 0.47 | 0.53 | 0.50 | 0.47 | 0.47 | 0.50 |
| Cross Section | Trilobal | Trilobal | Trilobal | Trilobal | Trilobal | Trilobal |
| Modification Ratio | 2.7 | 2.7 | 2.7 | 2.7 | 2.5 | 2.6 |
| Void Level (%) | — | — | — | — | — | — |
| Bulk* | 14.2 | 15.7 | 18.8 | 17.5 | 16.7 | 9.1 |
| Before Boil Off Properties | | | | | | |
| Denier | 1199 | 1257 | 1231 | 1281 | 1328 | 1260 |
| Denier Per Filament | 17.6 | 18.4 | 18.1 | 18.8 | 19.5 | 18.5 |
| Tenacity (g/d) | 2.54 | 2.53 | 2.43 | 2.10 | 2.39 | 2.05 |
| Elongation (%) | 37.0 | 42.5 | 49.0 | 44.5 | 52.0 | 44.5 |
| Modulus | 7.5 | 5.9 | 6.0 | 5.0 | 4.9 | 5.0 |
| After Boil Off Properties | | | | | | |
| Denier | 1235 | 1286 | 1262 | 1294 | 1363 | 1399 |
| Denier Per Filament | 18.1 | 18.9 | 18.5 | 19.0 | 20.0 | 20.6 |
| Tenacity (g/d) | 2.60 | 2.60 | 2.42 | 2.18 | 2.35 | 1.85 |
| Elongation (%) | 48.0 | 49.0 | 55.5 | 54.0 | 60.5 | 65.0 |
| Modulus | 5.2 | 4.1 | 4.3 | 3.1 | 3.1 | 2.1 |
| Percent Bulk Crimp Elon. | 36.7 | 47.9 | 47.2 | 54.3 | 43.5 | 27.7 |
| Crimp/cm | 2.24 | 2.56 | 2.95 | 2.36 | 4.57 | 2.17 |
| Percent Loop Shrinkage | 3.84 | 4.53 | 4.88 | 5.14 | 5.85 | 14.03 |
| Cold Dye Rate $\times 10^{-5}$ Sec$^{-1}$ | | | | | | |
| Fiber as Produced | 89 | 108 | 286 | 520 | 392 | 1660 |
| After Autoclave Steam Heat Set at: | | | | | | |
| 132° C. pH 4 | 1190 | 2280 | 3830 | 4760 | | |
| 138° C. pH 4 | 1820 | 2550 | 5560 | 7600 | 7690 | 13810 |
| 143° C. pH 4 | 4150 | 5500 | 8680 | 10800 | 9430 | |
| After Superba** Heat Set | | | | | | |
| 132° C. pH 4 | 615 | 1090 | 1830 | 2880 | 5620 | |

*Method described in U.S. Pat. No. 4,295,252.
**The steam heat set was carried out in a Superba TVP continuous heat setting machine.

EXAMPLE 5

Figure 2:
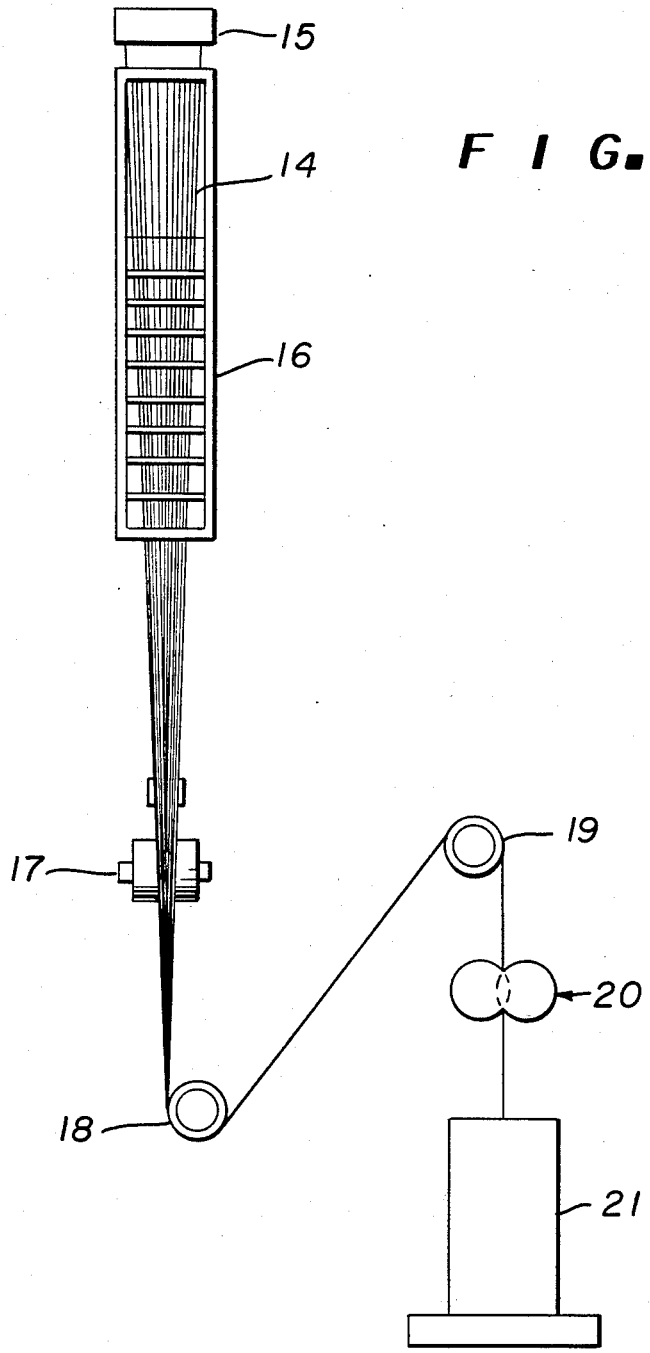
FIG. 2 is a schematic diagram of an alternative spinning procedure useful in preparing carpet yarns that are steam heat set according to the process of the present invention.
Figure 3:
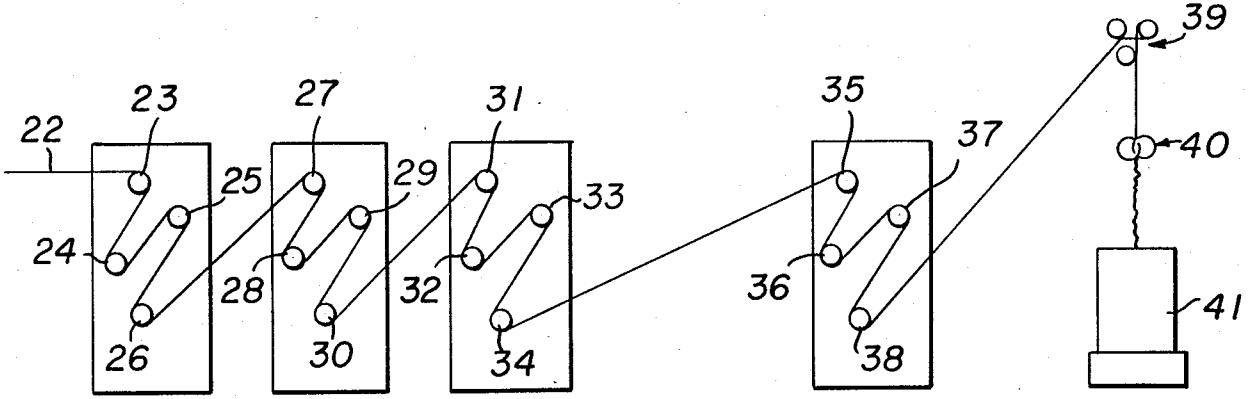
FIG. 3 is a schematic diagram of a drawing and crimping procedure useful to prepare carpet yarns that are steam heat set according to the process of the present invention.

Nylon tow is produced from 90 wt % nylon 66/10% nylon 6 copolymer similar to the yarn product of Example 1 except that the $TiO_2$ content was 0.0004. The process used in producing such tow is described with reference to the schematic diagrams in FIGS. 2 and 3. Referring first to FIG. 2, tow filaments 14 are extruded at 2.78 grams/minute/capillary through spinneret 15, quenched in chimney 16 by air at 8.49 meters/minute (12.8° C.), passed over primary finish applicator roll 17 rotating at 40 revolutions/minute, forwarded over feed roll 18 (rotating at a surface speed of 1216 meters/minute), over feed roll 19 (rotating at a surface speed of 1234 meters/minute), over puller roll 20 (rotating at a surface speed of 1361 meters/minute) and into piddler can 21. The tow is then drawn and crimped as shown in FIG. 3, wherein tow 22 is passed over roll 23 at a surface speed of 31.46 meters/minute, roll 24 at 31.73 meters/minute, roll 25 at 32.1 meters/minute, roll 26 at 32.3 meters/minute, roll 27 at 33.0 meters/minute, roll 28 at 34.02 meters/minute, roll 29 at 35.85 meters/minute, and roll 30 at 37.77 meters/minute. Tow 22 is then drawn over rolls 31, 32, 33, 34, 35, 36, 37, and 38 rotating at a surface speed of 100.6 meters/minute, over puller rolls 39 and crimper rolls 40. The speed of puller rolls 39 and crimper rolls 40 are adjusted for good operability to a surface speed of about 88.7 meters/minute, and the tow is deposited in container 41. The crimped tow is cut to a fiber length of 19.05 cms in a subsequent operation (not shown).

Another tow product of nylon 66 only made by the procedure described above was used as a control. The properties of the nylon 66/6 of this example and the control sample (Control 4) are given in Table VII. An attractive cut pile test carpet was made from twisted/-heat set yarns of this example. The details of its construction are given in Table VIII.

TABLE VI

CARPET CONSTRUCTION WITH YARNS OF EXAMPLE 4

| | |
|---|---|
| Style | Cut Pile |
| Tufter Gauge | ⅛" |
| Pile Height | ⅝" |
| Weight, Oz./Yd.$^2$ | 30 |
| Primary Backing | Typar |
| Secondary Backing | Jute |
| Dye Type | C.I. Acid Blue 40 |
| Color | Blue |
| Dye Process | Beck |
| Dye Concentration | 2.0% |
| Liquor Ratio | 40:1 |
| Dye Temperature | 25° C. |
| pH Adjustment | 8–4 |
| Yarn Twist (Singles) | 3.5 Z |
| Yarn Twist (Ply) (TPI) | 3.5 S |
| Autoclave Heat Set T °C. | 138 |

TABLE VII

| | Example 5 | Control 4 |
|---|---|---|
| Dye Type | RTD Acid | Deep Acid |
| Polymer Type | 66/6 | 66 |
| Blend Ratio | 90/10% | 100% |
| RV | 69.5 | 58 |
| $NH_2$ | 71.5 | 70.2 |
| COOH | *56 | *40 |
| Luster | Brt | D.B. |
| Percent $TiO_2$ | .0004 | 0.0000 |
| Percent Finish on Yarn | 1.0 | 1.2 |
| Cross Section | Trilobal | Trilobal |
| Modification Ratio | 3.1 | 3.1 |
| Void Level | — | — |
| Before Boil Off Properties | | |
| Tow Denier | 11,100 | 11,100 |
| Denier/filament | 16.6 | 15.7 |
| Tenacity (g/d) | 3.83 | 3.79 |
| Elongation (%) | 63 | 47 |
| Modulus | 8.07 | 8.15 |
| Cut Length (cm) | 19.05 | 19.05 |
| After Boil Off Properties | | |
| Filament Crimp Index | 22.13 | 23.28 |
| Crimp/cm | 4.96 | 5.36 |
| Shrinkage (%) | 12.6 | 9.5 |

TABLE VII-continued

| | Example 5 | Control 4 |
|---|---|---|
| Yarn Properties | | |
| Cotton Count | 3.25/2 | 3.25/2 |
| Singles Twist (Turns/cm) | 2.06 | 2.06 |
| Ply Twist (Turns/cm) | 1.67 | 1.67 |
| Cold Dye Rate $\times 10^{-5}$ Sec$^{-1}$ | | |
| as Produced (Spun) pH 4 | 1300 | 215 |
| as Produced (drawn) pH 4 | 177 | 10 |
| Steam Heat Set 132° C. pH 4 | 4200 | 116 |
| Steam Heat Set 132° C. pH 6 | 2800 | 52 |

*From Table

TABLE VIII

CARPET CONSTRUCTION WITH TOW OF EXAMPLE 5

| | |
|---|---|
| Style | Cut Pile |
| Tufter Gauge | ⅛" |
| Pile Height | 9/32" |
| Weight, Oz./Yd.$^2$ | 32 |
| Primary Backing | Typar |
| Secondary Backing | Jute |
| Dye Type | C.I. Acid Blue 40 |
| Color | Blue |
| Dye Process | Beck |
| Dye Concentration | 2.0% |
| Liquor Ratio | 40:1 |
| Dye Temperature | 25° C. |
| pH Adjustment | 8–4 |
| Yarn Twist (Singles) | 4.75 Z |
| Yarn Twist (Ply) (TPI) | 4.50 S |
| Autoclave Heat Set T °C. | 132 |

We claim:

1. In a method for producing carpet yarns with improved dyeability by forming filaments of nylon carpet yarn by extrusion of nylon polymer, subjecting the filaments thus formed to bulking or crimping at elevated temperatures and setting said filaments in staple or continuous form with saturated steam, the improvement which comprises forming the filaments from a random copolymer of nylon 66 and about 6–12% by weight of nylon 6 having an amine end content of 30–80 gram equivalents per 1000 kilograms of copolymer and a relative viscosity of 55–85 in filament form and heat setting the filaments with saturated steam at temperatures up to about the melting point of the polymer in saturated steam but not less than about the following temperatures according to their nylon 66 and nylon 6 content:

| % nylon 66 | % nylon 6 | Minimum Setting Temperature in Saturated Steam |
|---|---|---|
| 94 | 6 | 139° C. |
| 92 | 8 | 132° C. |
| 90 | 10 | 122° C. |
| 88 | 12 | 110° C. |

2. The method of claim 1 in which the copolymer of nylon 66 and nylon 6 contains 8–10% by weight of nylon 6 and has an amine end content of 40–70 gram equivalent per 1000 kilograms of copolymer and a relative viscosity of 65–75.

3. The method of claim 2 in which the copolymer of nylon 66 and nylon 6 contains 10% by weight of nylon 6 and the filaments are heat set at a temperature in the range of about 122° C. to about 160° C.

* * * * *